US005433317A

United States Patent [19]

Roser

[11] Patent Number: 5,433,317

[45] Date of Patent: Jul. 18, 1995

[54] BOX WITH INTEGRATED BOOKLET AND PROTECTIVE BARRIER THEREFOR

[76] Inventor: Mark C. Roser, 37 Cedar Ridge Ter., Glastonbury, Conn. 06033

[21] Appl. No.: 168,225

[22] Filed: Dec. 17, 1993

[51] Int. Cl.[6] ..... B65D 5/46

[52] U.S. Cl. ..... 206/232; 40/312; 281/31

[58] Field of Search ..... 206/232, 424; 40/312; 281/31

[56] References Cited

U.S. PATENT DOCUMENTS

| | | | |
|---|---|---|---|
| D. 175,722 | 10/1955 | Graham | 206/232 X |
| 223,432 | 1/1880 | Brooks | 206/232 X |
| 1,143,232 | 6/1915 | Schmidt | 40/312 |
| 1,963,552 | 6/1934 | Horwit | 281/31 X |
| 2,799,391 | 7/1957 | Eisner | 206/232 |
| 3,583,729 | 6/1971 | De Groot | 281/31 |
| 3,755,925 | 9/1973 | Court | 206/232 X |
| 4,336,664 | 6/1982 | Penick et al. . | |
| 4,643,301 | 2/1987 | Hehn et al. . | |
| 4,688,826 | 8/1987 | Hosoya . | |
| 4,700,831 | 10/1987 | Kassai | 206/232 |
| 5,021,274 | 6/1991 | Beck et al. . | |

*Primary Examiner*—Bryon P. Gehman
*Attorney, Agent, or Firm*—Hoffman, Wasson & Gitler

[57] ABSTRACT

A multi-page booklet is disclosed, comprising a front cover, a rear cover, a spine joining the covers, and several pages of information secured to the spine is disclosed. The covers may be pivoted relative to the spine to expose the pages of the booklet. The booklet is integrated with a conventional box and/or an auxiliary flap operatively associated with the box. The flap and-/or the covers of the booklet may be formed of a rigid material to serve as a protective cover, or barrier, for the booklet, which is printed of a lower quality paper. The flap, when closed, presses the booklet snugly against the rear panel of the box; when opened, the flap imparts stability to the box, and allows the consumer to read the pages of the booklet. Tabs may be formed at the free edge of the flap to lock same to the box, and retain the booklet pressed thereagainst, during packaging, handling, storage, and display. The information bearing capacity of the multi-page booklet is several times greater than the capacity found on the exterior surfaces of the conventional box, and present commercial potential for mass-marketing organizations.

3 Claims, 5 Drawing Sheets

BOX WITH INTEGRATED BOOKLET AND PROTECTIVE BARRIER THEREFOR

FIELD OF THE INVENTION

The present invention relates to methods for integrating a booklet and an auxiliary flap with the exterior of a box, and to the resultant box and booklet, protected by the flap, formed by such methods.

RELATED APPLICATIONS AND/OR DISCLOSURES

The Applicant asserts the retroactive benefit of related Disclosure Document 320,285, filed Nov. 9, 1992, and related Disclosure Document 321,459, filed Dec. 1, 1992.

BACKGROUND OF THE INVENTION

Rectangular boxes used for the containment of food, such as cereal, detergents, and other powdered or liquid goods, possess an inherent limitation which has not yet been fully overcome. The limitation of rectangular containers lies in the finite limit of available surface area. This limited area puts a limit on the amount of indicia which may be printed on the container, and labeling requirements dictated by law and custom may further reduce the area available to receive additional information.

The surface area is often extended by a few percent by printing on the tabs which get tucked under one of the openable sides. The surface area is also increased by extending one surface beyond the limits of the container, forming a cantilevered tab. This tab is often used to allow space for a hole which can be used to hang the container from a display rack. In small containers with major dimensions of only a few inches, this tab may help triple the surface area available for printing information. However, in containers with major dimensions of 10 inches and greater, such as cereal boxes, detergent boxes, etc., the employment of a tab will yield considerably less than 100% gain in surface area before it becomes awkward.

Having a limited surface area poses a problem for those manufacturers, distributors, or merchants, who wish to deliver an extended message on their packaging, because there is a limit to how many readable words can be printed on a finite surface. Companies who must provide long operating instructions, list safety precautions, or wish to advertise on the surfaces of their containers, are presently limited by the amount of surface area of the container.

Boxes filled with different cereals line the shelves of food stores, and are found in almost every American home. The nutritional values of cereals are highly promoted, and are well-known to the consumer. Several billions of boxes of cereal are sold every year.

Each box containing the cereal represents an attractive vehicle for conveying information to the consumer above and beyond the usual product and nutritional information. Such information may be educational in nature, or may convey additional facts about the product contained in the box, or about current events, or about a sports or entertainment star. Such information might be commercial in nature, and may advertise another product manufactured or distributed by the cereal company. Such information might be entertaining in nature, and may feature a fictional character, or real-life hero or heroine, whose exploits might interest, or intrigue, the individual consuming the cereal. Such information might also include puzzles, or games, which may benefit from the use of the container or parts thereof, as game pieces.

It is well known to adhere detachable, redeemable coupons to the exterior of boxes. The coupons may even be laminated to an exterior surface of the box. It is also well known to insert redeemable coupons into the interior of such boxes. A detailed discussion of detachable, redeemable coupons, may be found in U.S. Pat. No. 5,021,274, granted Jun. 4, 1991, to Louis B. Beck and Joseph C. Beck.

However, the redeemable coupons are relatively small and thin in size. Also, the coupons are usually removed the first time that the cereal box is opened, and are only intended to convey a limited amount of information to the consumer. Redeemable coupons do not address the problems associated with the limited area on a conventional container for printing additional messages, information, and the like. Thus,the techniques suitable for joining small, redeemable coupons to the exterior of cereal boxes and the like are not applicable to joining multi-page informational booklets to the exterior of a conventional cereal box.

Another solution for increasing the surface area available for an extended printed message utilizes a rigid auxiliary flap that is secured along one edge of a conventional box. The flap is formed of a rigid material, such as paper,and one, or both, sides thereof may be imprinted with additional information. At least one software manufacturer is presently using this packaging technique to provide additional surface area for printing retail sale information geared towards enticing point-of-purchase interest form consumers, while shopping, towards the computer program retained within the conventional box.

However, while the auxiliary flap provides 30–40% of additional surface area beyond the area available on a conventional box, such increase in surface area is insufficient for extensive advertising, storytelling, detailed and complex instructions, and the like. Thus, the need for increased surface areas that are several times larger than the capacity of the conventional box, or the conventional box plus an additional flap, remains unsatisfied.

SUMMARY OF THE INVENTION

The present invention builds upon the gain in printable surface area realized by the provision of an auxiliary flap, and realizes significant increases, in information carrying ability, by integrating a multi-page booklet with a conventional box, and then utilizing the auxiliary flap as a protective barrier for such booklet. Such multi-page booklet is formed of an inexpensive material, such as paper, that readily accepts printing ink, but lacks structural rigidity. The auxiliary flap, which is formed of a rigid material, such as laminated paper, stiff paper, paperboard, or cardboard, or plastic, is a prerequisite for preventing crumpling, soiling, or otherwise degrading the booklet during the life of the conventional box.

Additionally, the auxiliary flap imparts stability to the box; which improves the consumer's ability to read the contents of the booklet, while the flap and booklet are in the open position. The opened flap provides resistance to tipping of the box and booklet, either backwards or forwards. The opened flap helps the pages of the booklet to remain erect while reading.

Furthermore, locking systems are defined by a tab on the free edge of the auxiliary flap, and the box. The locking systems, which may assume the form of a tab on the flap and a slot in the box, or hook and eye fasteners on the tab and box, or adhesives on the tab and/or a side wall of the box, retain the flap locked tightly against the box, and ensure that the front to back dimension of the box and booklet is not materially increased. Thus, the resultant box can be packaged, stored, and displayed in the same manner as a conventional box.

Several methods for integrating the booklet and flap with the conventional box are disclosed. One method relies upon an integrally formed blank comprising a box and an auxiliary flap, joined along a hinge line. Another method relies upon an auxiliary flap with an anchor leg that is secured to a side wall of the box. Yet another method relies upon forming the auxiliary flap from a layer of rigid material adhered to the rear panel of a box; the layer is scored or perforated, so that the flap can be released therefrom and pivoted into an operative position.

DESCRIPTION OF THE PREFERRED EMBODIMENT

Figure 1:
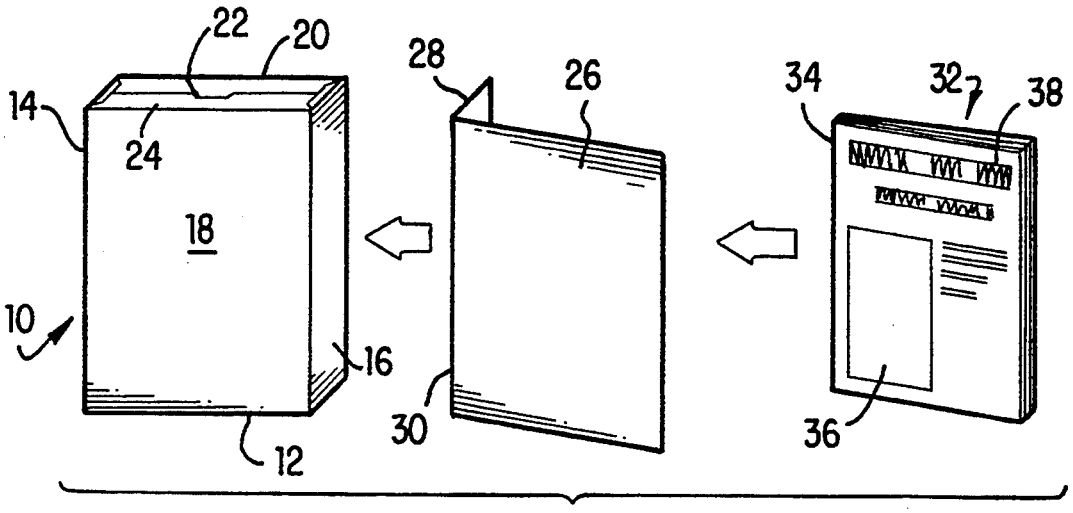
FIG. 1 is an exploded perspective view of a preferred embodiment of the invention constructed in accordance with the principles of the invention, such view showing a conventional box, a multi-page booklet, and an auxiliary flap for integration with said box.
Figure 2:
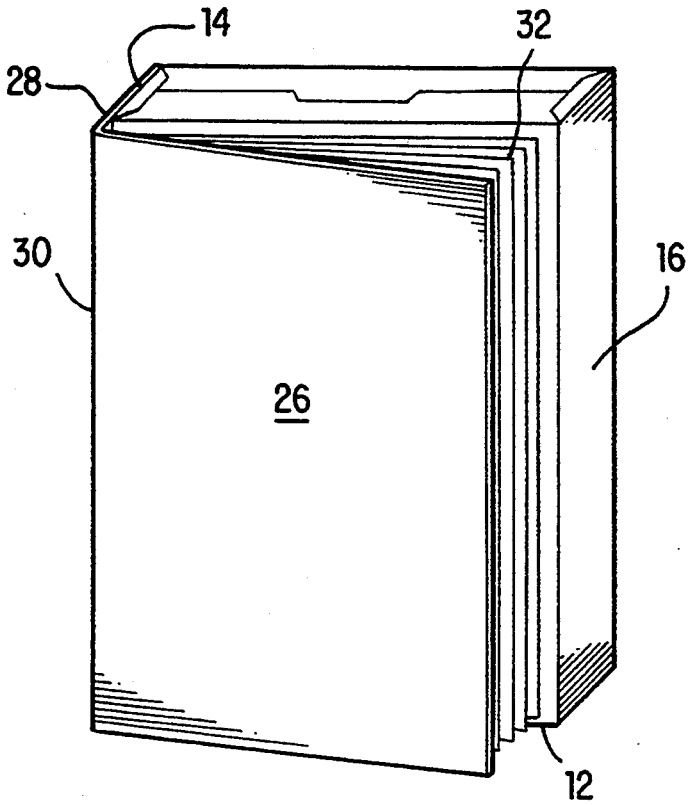
FIG. 2 is a rear perspective view, on an enlarged scale, of the box of FIG. 1, after the auxiliary flap and booklet have been integrated with said box.

FIGS. 1 and 2 present a preferred embodiment of the present invention. More particularly, FIG. 1 depicts a box 10 of known construction. Box 10 is formed from a blank of rigid, self-supporting paper, and includes a bottom 12, a first side wall 14, a second side wall 16, a rear panel 18 and a corresponding front panel 20. The upwardly opening top of box 10, through which the contents are introduced into the interior of the box, is sealed by interlocking tabs 22, 24.

An auxiliary flap 26, with an upstanding anchor leg 28, is also formed of rigid paper, or a similar material. Flap 26 is comparable in size to rear panel 18 on box 10, and flap 26 can be pivoted relative to anchor leg 28, along vertical hinge line 30.

A multi-page booklet 32, formed of a lower quality paper that will accept printing thereon, is also visible in FIG. 1. A spine 34 extends vertically along one side of booklet 32. A premium coupon 36, and advertising copy 38, may be imprinted on the pages of booklet 32. Booklet 32 is smaller in size than auxiliary flap 26.

As shown in FIG. 2, auxiliary flap 26 and booklet 32 have been integrated with box 10. Anchor leg 28 is glued, or otherwise joined, to side wall 14 of box 10, and spine 34 of booklet 32 is glued, or stapled, or sewn, or otherwise joined to box 10 or auxiliary flap 26 along vertical hinge line 30. Auxiliary flap 26 is pivoted about hinge line 30, so that access can be gained to all of the pages of booklet 32. Some additional information may be imprinted on flap 26, and particularly within booklet 32, thereby increasing the information carrying capacity of the integrated box several fold. Also, auxiliary flap 26 serves as a protective barrier for booklet 32. Additionally, flap 26 imparts stability to the box and booklet, for the flap resists tipping while the flap and booklet are in the opened position. Furthermore, flap 26 retains the pages of booklet 32 in erect condition, while the booklet is opened.

Figure 3:
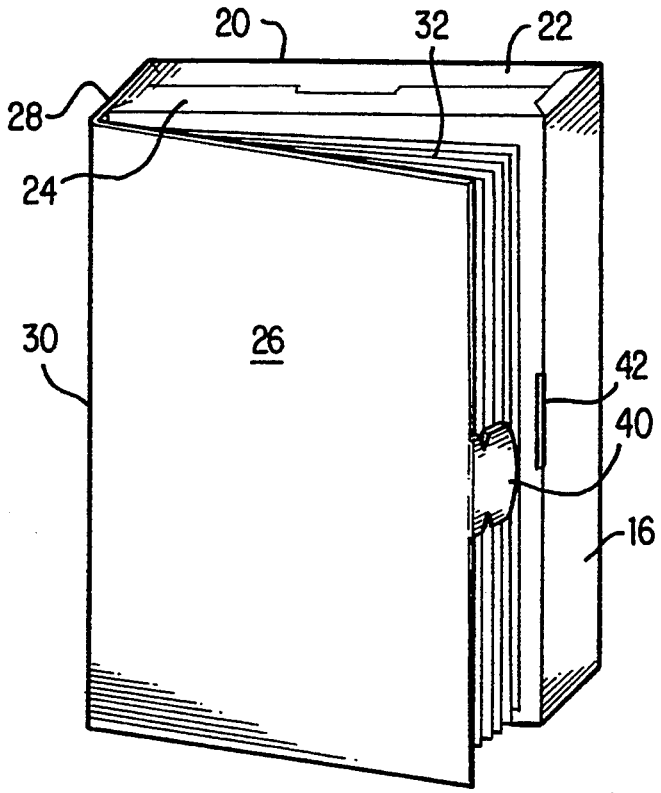
FIG. 3 is a rear perspective view of a tab and slot for retaining the auxiliary flap against the rear of said box.

FIG. 3 shows a modification of the preferred embodiment of FIGS. 1–2. In order to retain flap 26 and booklet 32 pressed tightly against rear panel 18 of box 10, a tab 40 is formed on flap 26 at the edge remote from hinge line 30. A slot 42 is diecut, or slit, at the juncture of rear panel 18 and side wall 16 in box 10. Tab 40 and slot 42 retain booklet 32 and flap 26 pressed tightly against the rear panel of box 10, so that the front to back dimension of the box remains unchanged during packing, shipping, handling, and display.

Figure 4:
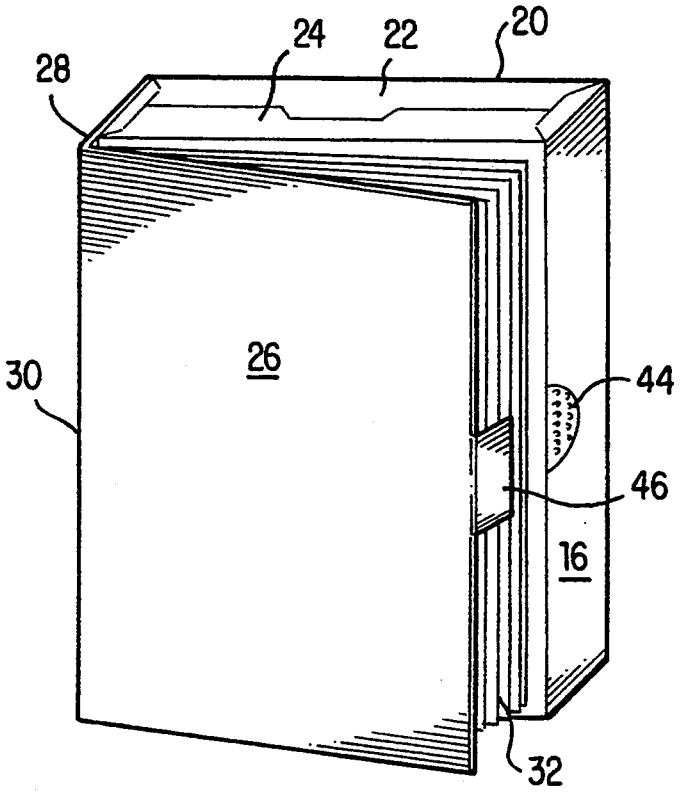
FIG. 4 is a rear perspective view of a hook and eye fastener for retaining the auxiliary flap against the rear of said box.

FIG. 4 shows another modification of the preferred embodiment of FIGS. 1–2. In lieu of the slot and tab cooperation of FIG. 3, several hooks 44 are secured to the exterior of panel 16 of box 10, and cooperating loops are secured to the underside of tab 46. Consequently, when tab 46 is pressed against hooks 44, flap 26 and booklet 32 are retained snugly against rear panel 18 of box 10. The hook and loop fasteners may assume the form of the well-known "Velcro" ®fasteners.

ALTERNATIVE EMBODIMENTS

Figure 5:
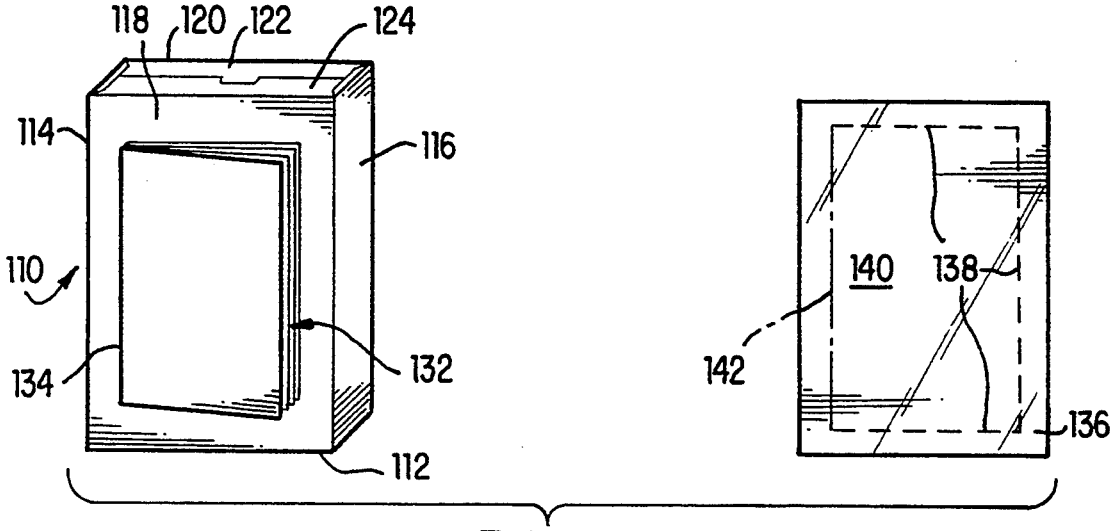
FIG. 5 is an exploded perspective view of an alternative embodiment of the instant invention, such view showing a conventional box with a booklet integrated therewith, and a rigid sheet for forming the auxiliary flap.
Figure 6:
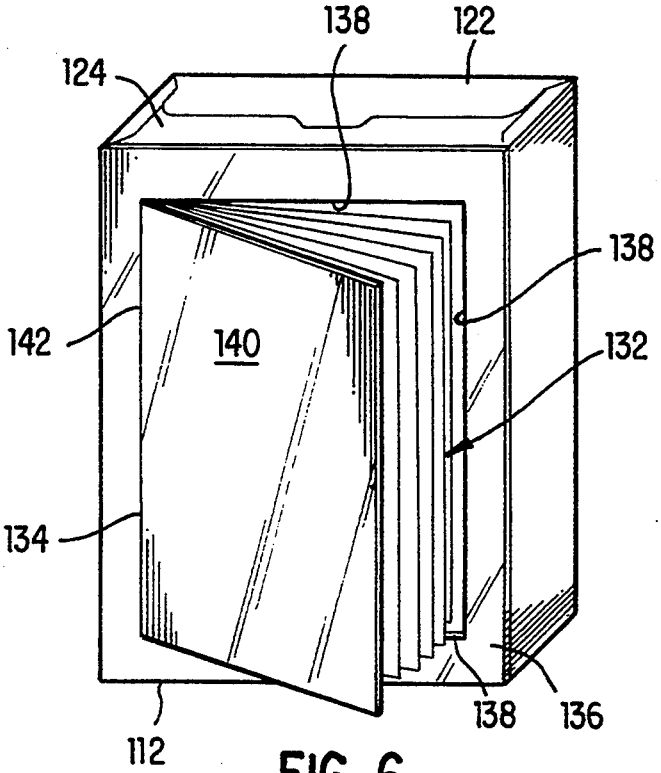
FIG. 6 is a rear perspective view of the box and overlay of FIG. 5, on an enlarged scale, with the auxiliary flap and booklet pivoted away from the rear of said box.

FIGS. 5–6 depict an alternative embodiment of the present invention. A conventional box 110 comprises a bottom 112, a first side wall 114, a second side wall 116, a rear panel 118, and a front panel 120. The upwardly opening top of the box is sealed by interlocking tabs 122, 124.

Booklet 132 has its rear surface secured to rear panel 118 of box 110, and the pages of the booklet can be turned about vertical spine 134 of booklet 132. Booklet 132 is rectangular in shape, and is smaller in size than panel 118 of box 110. Spine 134 is parallel to the side wall 114, and is spaced inwardly therefrom on rear panel 118 of box 110.

A layer 136 of rigid paper, or transparent plastic, approximately equal in size to rear panel 118, is secured to such panel. The securement may be achieved by applying glue, or other adhesives, along the perimeter of layer 136. Scored lines, or perforations 138, are defined along three sides of layer 136, as shown in FIG. 5, while the side adjacent panel 114 remains intact.

Layer 136 serves as a protective cover, or barrier, for booklet 132. Prior to puncturing, or tearing, perforations 138, booklet 132 is sealed by layer 136 and pressed tightly against the rear panel of box 110. When the perforations are torn, an auxiliary flap 140 is released from layer 136. Auxiliary flap 140 pivots about vertical hinge line 142, which is situated adjacent to, and parallel with, the edge of wall 114. The flap is pivoted away from box 110 to expose the contents of booklet 32, and is pivoted toward box 110 to re-seal booklet 32.

Figure 7:
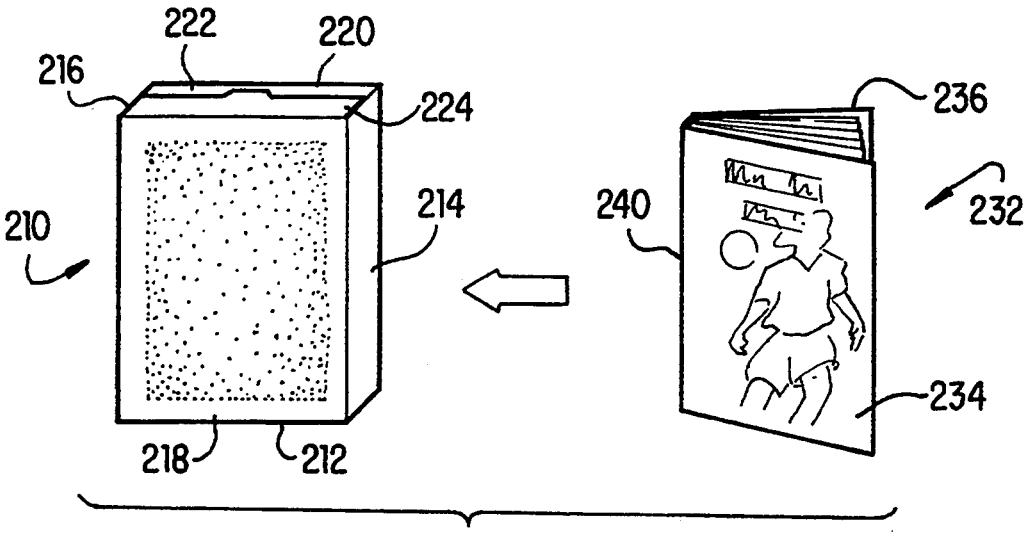
FIG. 7 is an exploded perspective view of another alternative embodiment of the instant invention, such view showing a conventional box, with a section of the rear panel prepared with an adhesive material, and a booklet for integration therewith.
Figure 8:
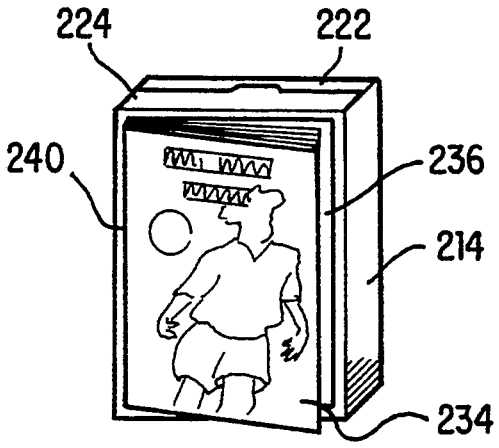
FIG. 8 is a rear perspective view of the conventional box and booklet of FIG. 7, after the booklet has been integrated thereto.

FIGS. 7–8 depict a second alternative embodiment of the present invention. A conventional box 210 comprises a bottom 212, a first side wall 214, a second side wall 216, a rear panel 218, and a front panel 220. The upwardly opening top of the box is sealed by interlocking tabs 222, 224.

Booklet 232 is formed in a somewhat different fashion from booklets 32 and 132 of the preferred embodiment, and the alternative embodiment. Instead of both covers of the booklet being formed of inexpensive, low quality paper that lacks structural rigidity, front and rear covers 234, 236 are formed of durable, rigid paper or plastic. The covers are capable of protecting the interior pages of booklet 232, and obviate the need for auxiliary flaps 26 and 126, respectively.

Rear cover 236 is similar in size to rear panel 218 or side wall 214, and is glued, or otherwise fastened, to the appropriate rear panel, or side wall. Front cover 234 is pivoted about spine 240 of booklet 232, so that the contents of the booklet may be observed.

Figure 9:
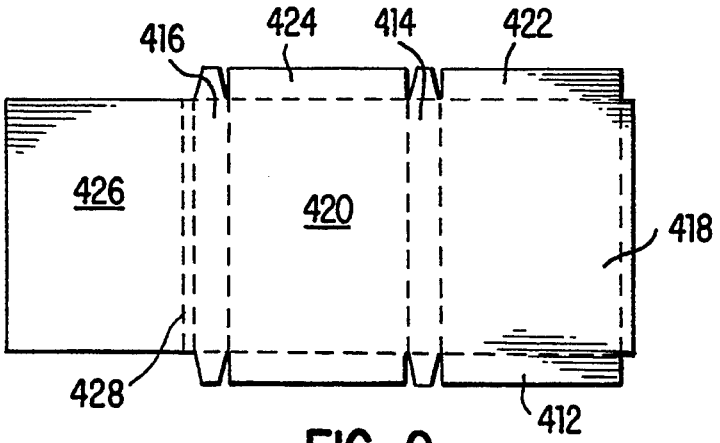
FIG. 9 is a top plan view of yet another alternative embodiment of the instant invention, such view showing, in plan view, a blank having the auxiliary flap integrally formed therewith.
Figure 10:
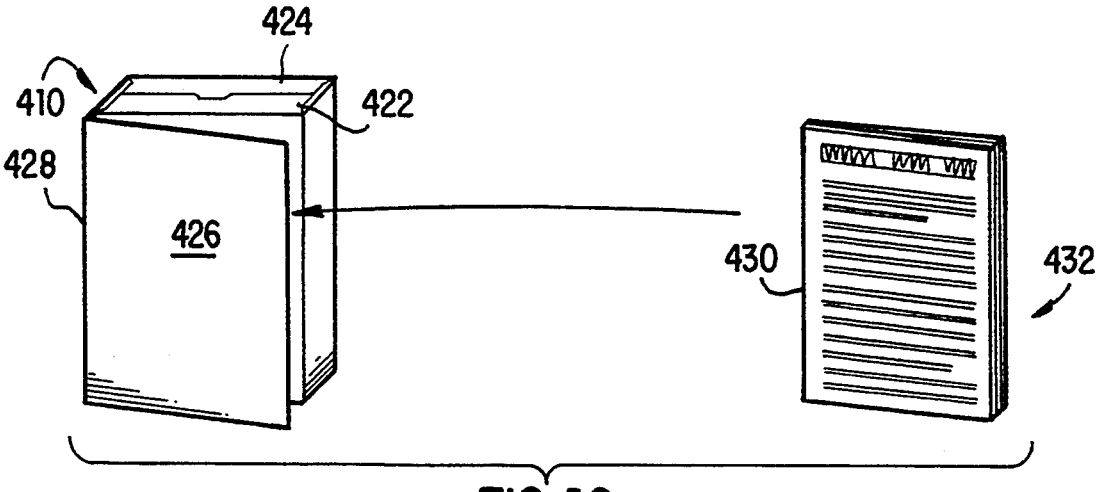
FIG. 10 is an exploded perspective view of the novel blank of FIG. 9, in its erected condition and a booklet suited for integration with the erected box; and, FIG. 11 is a perspective view of the blank of FIG. 9 with the booklet of FIG. 10 integrated therewith.
Figure 11:
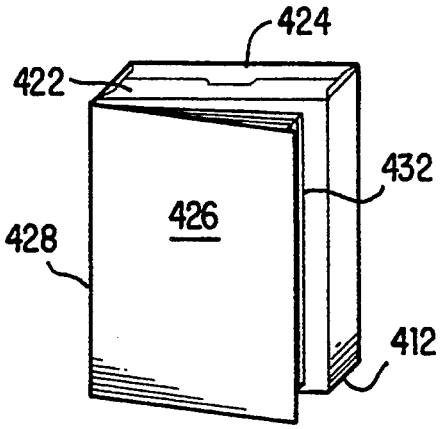

FIGS. 9–11 depict a third alternative embodiment of the present invention. Box 410 is erected from the blank of FIG. 9. Such blank includes a bottom 412, a first side wall 414, a second side wall 416, a rear panel 418, and a front panel 420. The upwardly opening top of the box is sealed by interlocking tabs 422, 424.

While the foregoing components are present in conventional box blanks, the blank of FIG. 9 reveals an integrally formed auxiliary flap 426, that is pivotable about hinge line 428. The erected blank turns into box 410, and the spine 430 of booklet 432 is integrated with flap 426 and box 410, as suggested in FIGS. 10. Flap 426 is pivoted about hinge line 428 to reveal the contents of booklet 432, as shown in FIG. 11. Flap 426 serves as a protective barrier, or cover, for booklet 432, when the booklet is read by the consumer. When the booklet is not in use, flap 426 presses same firmly against the rear panel 418 of box 410.

Other modifications, revisions, and alterations may occur to the skilled artisan from a study of the foregoing representative embodiments of the present invention. For example, the protective flap and multi-page informational booklet might be used for delivering recipes on cake mix boxes, delivering and protecting safety data sheets on industrial chemical boxes, providing technical/installation manuals on parts boxes, and applications too numerous to mention. Additionally, tabs 40, 46 might be glued to side wall 16 of the box, during packing shipping, and display, thus, allowing the consumer to be assured of a tamper-free unit, as has historically been done in the cereal industry. Consequently, the appended claims must be broadly construed in a manner consistent with the spirit of the invention, and should not be limited to their literal terms.

I claim:

1. In combination a box with a booklet integrated therewith, said combination comprising:

a) said box including a first panel and a second panel parallel thereto, side walls joining said first and second panels, a bottom, and a top, b) a booklet comprising a front cover and a rear cover, a spine, and printed pages secured to said spine between said covers, c) said rear cover of said booklet being secured to one of said panels of said box, d) a rectangular sheet of rigid material being secured to said box to encase said booklet against said one panel, e) said sheet having perforations along several side thereof, f) said perforations, when torn, allowing an auxiliary flap defined by said sheet to be pivoted away from said box, while the residual segments of said sheet remain secured thereto.

2. A box with a booklet and an auxiliary flap integrated therewith as defined in claim 1 wherein said sheet is approximately equal in size to the rear panel of said box, and said sheet is formed of plastic.

3. A box with a booklet and an auxiliary flap integrated therewith as defined in claim 1 wherein said sheet is perforated along three sides thereof, and the auxiliary flap pivots about a hinge line that is coincident with the spine of said booklet.

* * * * *